US010820136B2

(12) United States Patent
Noh

(10) Patent No.: US 10,820,136 B2
(45) Date of Patent: Oct. 27, 2020

(54) SYSTEM AND METHOD FOR PRECONDITIONING AUDIO SIGNAL FOR 3D AUDIO VIRTUALIZATION USING LOUDSPEAKERS

(71) Applicant: DTS, Inc., Calabasas, CA (US)

(72) Inventor: Daekyoung Noh, Huntington Beach, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 16/163,812

(22) Filed: Oct. 18, 2018

(65) Prior Publication Data

US 2019/0116451 A1 Apr. 18, 2019

Related U.S. Application Data

(60) Provisional application No. 62/573,966, filed on Oct. 18, 2017.

(51) Int. Cl.

| | |
|---|---|
| ***H04S 3/00*** | (2006.01) |
| ***H04S 7/00*** | (2006.01) |
| ***H04R 5/04*** | (2006.01) |

(52) U.S. Cl.

CPC ..... *H04S 7/307* (2013.01); *H04R 5/04* (2013.01); *H04S 3/002* (2013.01); *H04S 2400/01* (2013.01); *H04S 2420/01* (2013.01)

(58) Field of Classification Search

None

See application file for complete search history.

(56) References Cited

U.S. PATENT DOCUMENTS

| | | | |
|---|---|---|---|
| 5,666,424 | A | 9/1997 | Fosgate |
| 6,577,736 | B1 | 6/2003 | Clemow |
| 7,231,054 | B1 | 6/2007 | Jot et al. |

(Continued)

FOREIGN PATENT DOCUMENTS

WO WO-2019079602 A1 4/2019

OTHER PUBLICATIONS

Choueiri, Edgar, "Optimal Crosstalk Cancellation for Binaural Audio with Two Loudspeakers", Princeton University, (2015), 24 pgs.

(Continued)

*Primary Examiner* — James K Mooney

(74) *Attorney, Agent, or Firm* — Schwegman Lundberg & Woessner, P.A.

(57) ABSTRACT

The methods and apparatus described herein provides technical solutions to the technical problems facing crosstalk cancellation for 3D audio virtualization. One technical solution includes preconditioning audio signals based on crosstalk canceller characteristics and based on characteristics of sound sources at intended locations in 3D space. To provide these technical solutions, the systems and methods described herein include an audio virtualizer and an audio preconditioner. In particular, the audio virtualizer includes a crosstalk canceller, and the audio preconditioner preconditions audio signals based on characteristics of a crosstalk cancellation system and based on characteristics of a binaural synthesis system or intended input source location in space. This solution improves the overall accuracy of virtualization of 3D sound sources and reduces or eliminates audio artifacts such as incorrect localization, inter-channel sound level imbalance, or a sound level that is higher or lower than intended.

20 Claims, 7 Drawing Sheets

(56) References Cited

U.S. PATENT DOCUMENTS

| | | | |
|---|---|---|---|
| 8,619,998 | B2 | 12/2013 | Walsh et al. |
| 9,532,158 | B2 | 12/2016 | Lando et al. |
| 9,826,328 | B2 | 11/2017 | Mehta et al. |
| 2003/0007648 | A1 | 1/2003 | Currell |
| 2008/0025534 | A1 | 1/2008 | Kuhn et al. |
| 2008/0031462 | A1 | 2/2008 | Walsh et al. |
| 2012/0243713 | A1 | 9/2012 | Hess |
| 2014/0270281 | A1 | 9/2014 | Walsh et al. |
| 2014/0286511 | A1 | 9/2014 | Nakano |
| 2015/0131824 | A1 | 5/2015 | Nguyen et al. |
| 2015/0223002 | A1 | 8/2015 | Mehta et al. |
| 2016/0044431 | A1 | 2/2016 | Kraemer et al. |
| 2016/0134987 | A1 | 5/2016 | Gorzel et al. |
| 2016/0134989 | A1 | 5/2016 | Herre et al. |
| 2018/0077511 | A1 | 3/2018 | Mehta et al. |

OTHER PUBLICATIONS

Masiero, Bruno, et al., "Review of the crosstalk cancellation filter technique", Proceedings of ICSA, (2011), 112-116.

Mingsian, Bai, et al,, "Objective and subjective analysis of effects of listening angle on crosstalk cancellation in spatial sound reproduction", J. Acoust. Soc. Am. 120 (4), (Oct. 2006), 1976-1989.

Parodi, Yesenia, et al., "Analysis of Design Parameters for Crosstalk Cancellation Filters Applied to Different Loudspeaker Configurations*", J. Audio Eng. Soc., vol. 59, No. 5, (2011), 304-320.

"International Application Serial No. PCT/US2018/056524, International Search Report dated Jan. 16, 2019", 3 pgs.

"International Application Serial No. PCT/US2018/056524, Written Opinion dated Jan. 16, 2019", 7 pgs.

SYSTEM AND METHOD FOR PRECONDITIONING AUDIO SIGNAL FOR 3D AUDIO VIRTUALIZATION USING LOUDSPEAKERS

RELATED APPLICATION AND PRIORITY CLAIM

This application is related and claims priority to U.S. Provisional Application No. 62/573,966, filed on Oct. 18, 2017 and entitled "System and Method for Preconditioning Audio Signal for 3D Audio Virtualization Using Loudspeakers," the entirety of which is incorporated herein by reference.

TECHNICAL FIELD

The technology described herein relates to systems and methods for audio signal preconditioning for a loudspeaker sound reproduction system.

BACKGROUND

A 3D audio virtualizer may be used to create a perception that individual audio signals originate from various locations (e.g., are localized in 3D space). The 3D audio virtualizer may be used when reproducing audio using multiple loudspeakers or using headphones. Some techniques for 3D audio virtualization include head-related transfer function (HRTF) binaural synthesis and crosstalk cancellation. HRTF binaural synthesis is used in headphone or loudspeaker 3D virtualization by recreating how sound is transformed by the ears, head, and other physical features. Because sound from loudspeakers are transmitted to both ears, crosstalk cancellation is used to reduce or eliminate sound from one loudspeaker from reaching an opposite ear, such as sound from a left speaker reaching a right ear. To create the perception that audio signals from loudspeakers are correctly localized in 3D space, crosstalk cancellation is used to reduce or eliminate the acoustic crosstalk of sound so that the sound sources can be neutralized at the listener's ears. While the goal of crosstalk cancellation is to represent binaurally synthesized or binaurally recorded sound in 3D space as if the sound source emanates from intended locations, practical challenges (e.g., listener's location, acoustic environments being different from the crosstalk cancellation design), it is extremely difficult to achieve a perfect crosstalk cancellation. This imperfect crosstalk cancellation can result in inaccurate virtualization that may create localization error, undesirable timbre and loudness changes, and incorrect sound field representation. What is needed is improved crosstalk cancellation for 3D audio virtualization.

DESCRIPTION OF EMBODIMENTS

Figure 1:
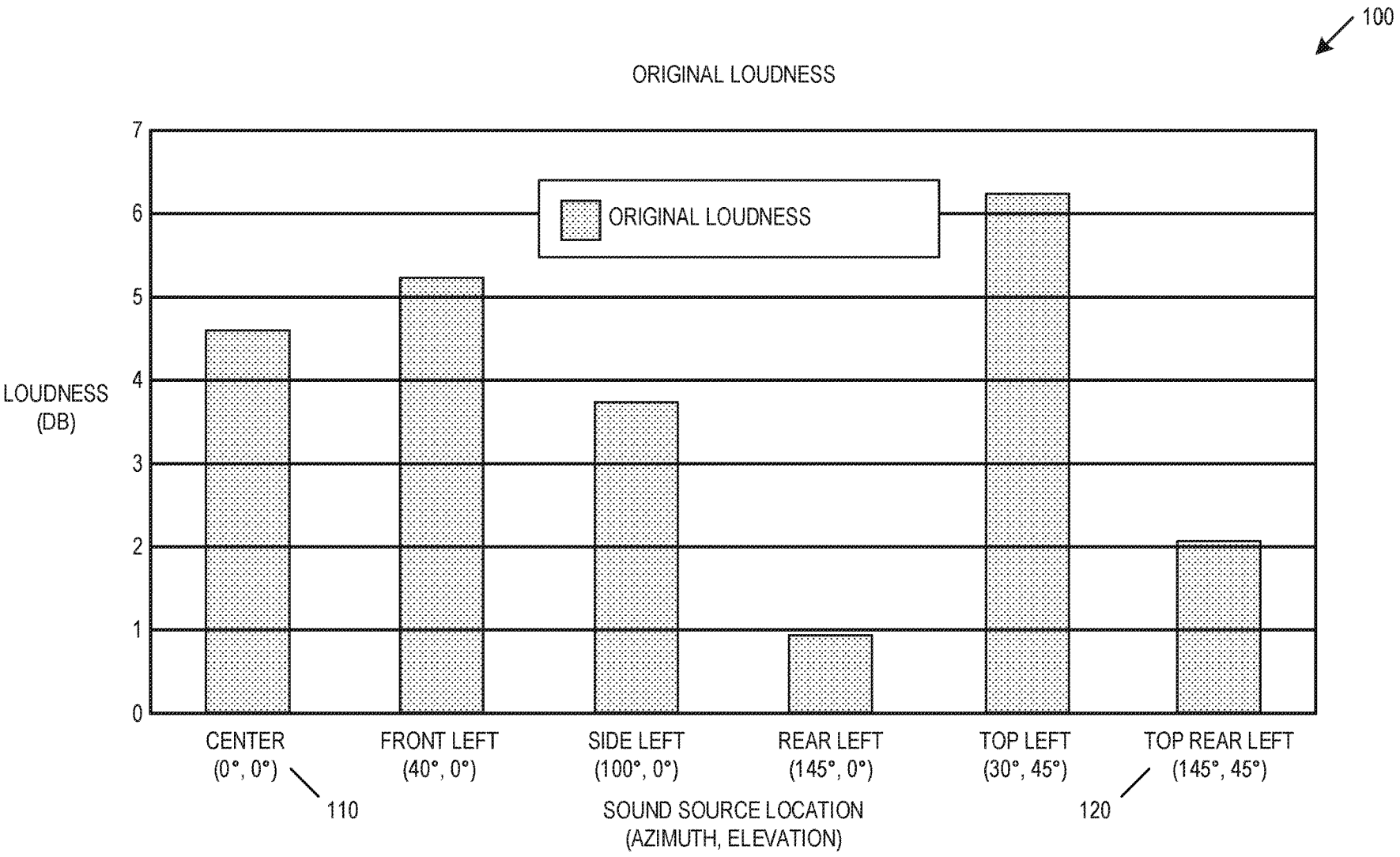
FIG. 1 includes an original loudness bar graph, according to an example embodiment.

The present subject matter provides technical solutions to the technical problems facing crosstalk cancellation for 3D audio virtualization. One technical solution includes preconditioning audio signals based on crosstalk canceller characteristics and based on characteristics of sound sources at intended locations in 3D space. This solution improves the overall accuracy of virtualization of 3D sound sources and reduces or eliminates audio artifacts such as incorrect localization, inter-channel sound level imbalance, or a sound level that is higher or lower than intended. In addition to crosstalk cancellation, this technical solution also provides an improved representation of binaural sound that accounts accurately for the combined coloration and loudness differences of binaural synthesis and crosstalk cancellation. In addition to improved binaural sound representation, this solution provides greater flexibility by providing a substantially improved crosstalk canceller for arbitrary listeners with an arbitrary playback system in an arbitrary environment. For example, this technical solution provides substantially improved crosstalk cancellation regardless of variation individuals' Head Related Transfer Functions (HRTFs), variation in audio reproduction (e.g., in a diffuse or free field), variation in listener position or number of listeners, or variation in the spectral responses of playback devices.

To provide these technical solutions, the systems and methods described herein include an audio virtualizer and an audio preconditioner. In particular, the audio virtualizer includes a crosstalk canceller, and the audio preconditioner preconditions audio signals based on characteristics of a crosstalk cancellation system and based on characteristics of a binaural synthesis system or intended input source location in space. The systems and methods describe herein provide various advantages. In an embodiment, in addition to achieving improved accuracy of virtualization, this systems and methods described herein do not require redesigning crosstalk canceller or its filters for different binaural synthesis filters, and instead leverage modifying filters to implement taps and gains. Another advantage includes scalability of complexity in system design and computation resources, such as providing the ability to modify a number of input channels, the ability to modify groups of values if resource-constrained, or the ability to modify frequency-dependence or frequency-independence based on a number of frequency bins. An additional advantage is the ability to provide the solution with various particular and regularize crosstalk cancellers, including those that consider audio source location, filter response, or CTC azimuth or elevation. An additional advantage is the ability to provide flexible tuning for various playback devices or playback environments, where the flexible tuning may be provided by a user, by an original equipment manufacturer (OEM), or by another party. These systems and methods may provide improved crosstalk cancellation for 3D audio virtualization in various audio/video (A/V) products, including televisions, sound bars, Bluetooth speakers, laptops, tablets, desktop computers, mobile phones, and other A/V products.

The detailed description set forth below in connection with the appended drawings is intended as a description of the presently preferred embodiment of the present subject matter, and is not intended to represent the only form in which the present subject matter may be constructed or used. The description sets forth the functions and the sequence of steps for developing and operating the present subject matter in connection with the illustrated embodiment. It is to be understood that the same or equivalent functions and sequences may be accomplished by different embodiments that are also intended to be encompassed within the spirit and scope of the present subject matter. It is further understood that the use of relational terms (e.g., first, second) are used solely to distinguish one from another entity without necessarily requiring or implying any actual such relationship or order between such entities.

FIG. 1 includes an original loudness bar graph 100, according to an example embodiment. Graph 100 shows an original (e.g., unprocessed) sound source level for various audio source directions (e.g., speaker locations). Each audio source direction is described relative to the listener by an azimuth and elevation. For example, center channel 110 is directly in front of a listener at 0° azimuth and 0° elevation, whereas top rear left channel 120 is at 145° azimuth (e.g., rotated counterclockwise 145° from center) and 45° elevation. The sound source levels represent the natural sound levels from each location, which are calculated based on the power sum of ipsilateral and contra lateral HRTFs of each azimuths and elevation angles with B-weighting. The differences between the sound levels at the various locations are due to differing timber and sound level from each audio source direction. In contrast to the unprocessed sound source levels shown in FIG. 1, binaurally synthesized sound would have different associated timbre and sound level, such as shown in FIG. 2 and FIG. 3.

Figure 2:
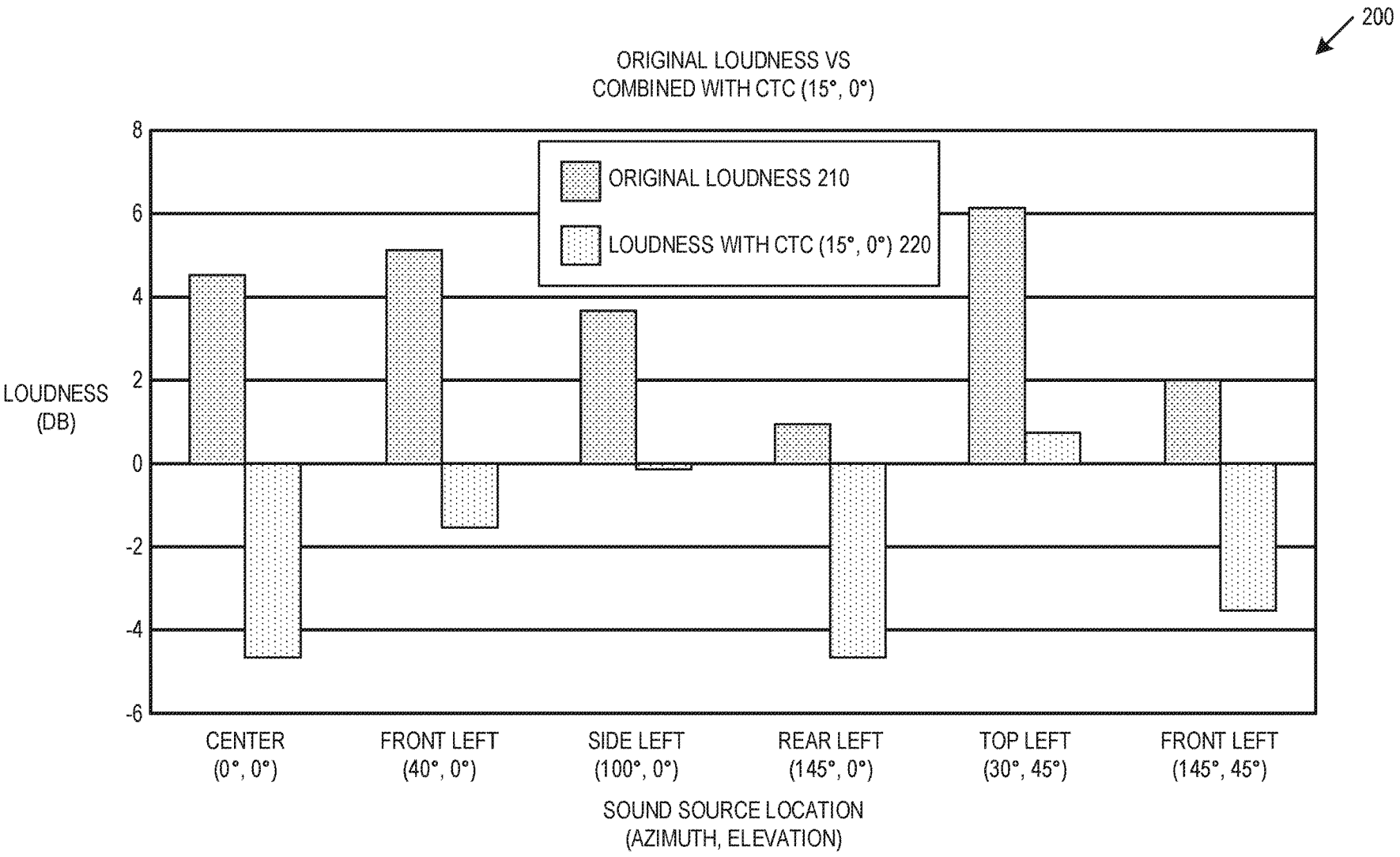
FIG. 2 includes a first crosstalk cancellation loudness bar graph, according to an example embodiment.

FIG. 2 includes a first crosstalk cancellation loudness bar graph 200, according to an example embodiment. For each sound source location, graph 200 shows both original loudness 210 and loudness with crosstalk cancellation (CTC) 220. In the embodiment shown in graph 200, the crosstalk cancellation 220 is designed for a device at 15° azimuth and 0° elevation. As can be seen in FIG. 2, the original loudness 210 is greater than loudness with CTC 220 for each sound source location. Graph 200 does not include acoustic crosstalk cancellation so the differences in loudness will not be exactly the same at the listener's ears, however it is still clear that the differences in loudness for each sound source varies among the various sound source locations. This variation in loudness differences show that a single gain compensation would not recover the loudness of sound sources in different sound source locations back to original loudness levels. For example, an audio gain of 9 dB may recover loudness for the center channel, but the same audio gain of 9 dB would overcompensate the other channels shown in graph 200.

Figure 3:
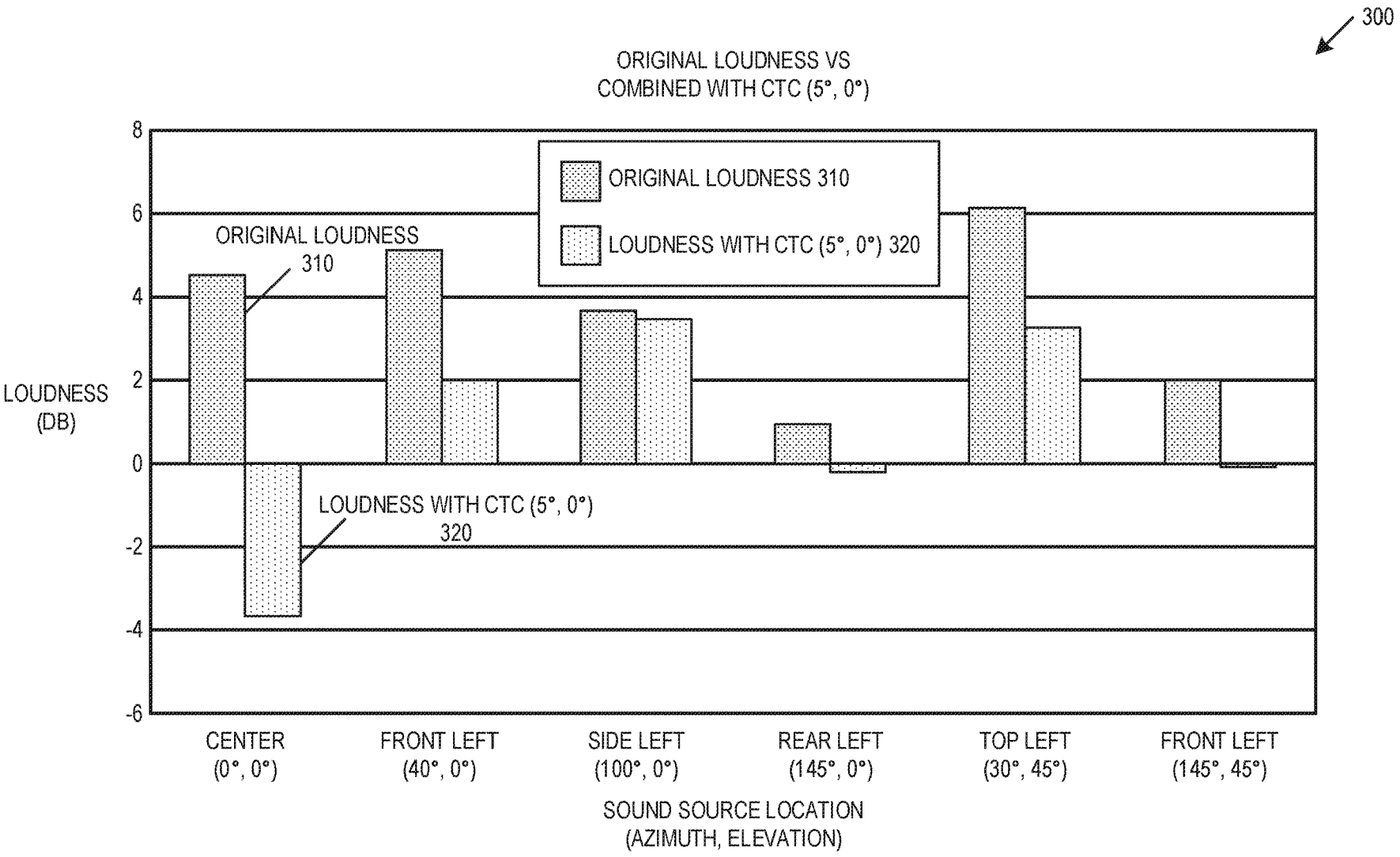
FIG. 3 includes a second CTC loudness bar graph, according to an example embodiment.

FIG. 3 includes a second CTC loudness bar graph 300, according to an example embodiment. Similar to FIG. 2, FIG. 3 shows both original loudness 310 and loudness with CTC 320, however here the loudness with CTC 320 is designed for a device at 5° azimuth and 0° elevation. As with FIG. 2, the original loudness 310 is greater than the loudness with CTC 320 for each sound source location, and the variation between the original loudness 310 and the crosstalk cancellation 320 is different for each sound source location, so a single gain compensation would not recover the loudness of sound sources in different sound source locations.

In contrast with the use of a single gain compensation, the technical solutions described herein provide a compensation that considers characteristics of both CTC systems and of the sound sources in separate locations. These solutions compensate for the differences in coloration and loudness, while preserving the timbre and loudness of the original sound sources in 3D space. In particular, these solutions include signal preconditioning (e.g., filter preconditioning) performed prior to a crosstalk canceller, where the signal preconditioning is based on both the spectral response of the crosstalk canceller and on characteristics of a binaural synthesis system or intended input source location in space. This signal preconditioning includes pre-analysis of the overall system to determine binaural synthesis and crosstalk cancellation characteristics. This pre-analysis generates CTC data sets that are applied during or prior to audio signal processing. In various embodiments, the generated CTC data sets may be built into binaural synthesis filters or systems. For example, a binaural synthesis system may include a combination of hardware and software device that implement the binaural synthesis and crosstalk cancellation characteristics based on the generated CTC data sets. An example of this pre-analysis for preconditioning is loudness analysis, such as described with respect to FIG. 4.

Figure 4:
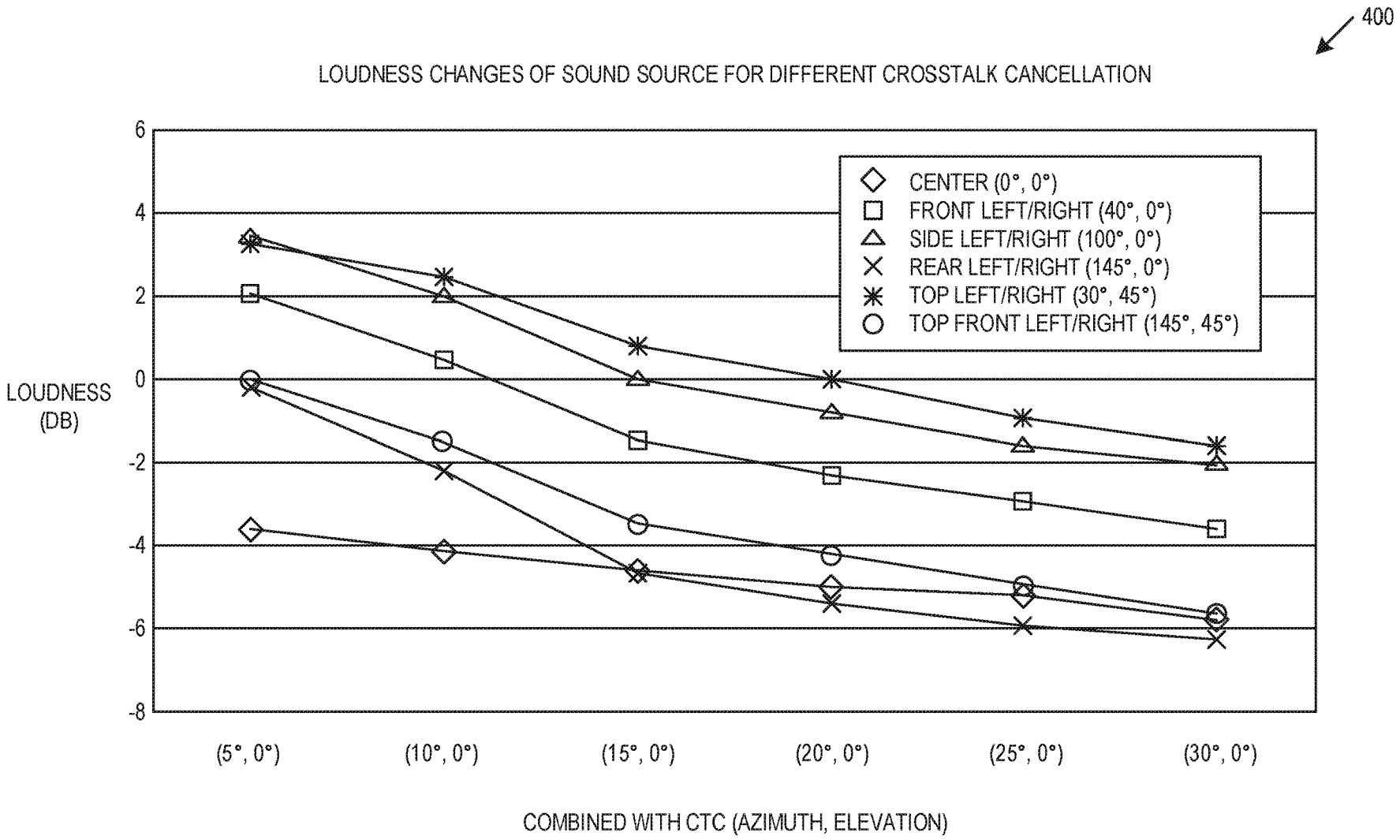
FIG. 4 includes a CTC loudness line graph, according to an example embodiment.
Figure 6:
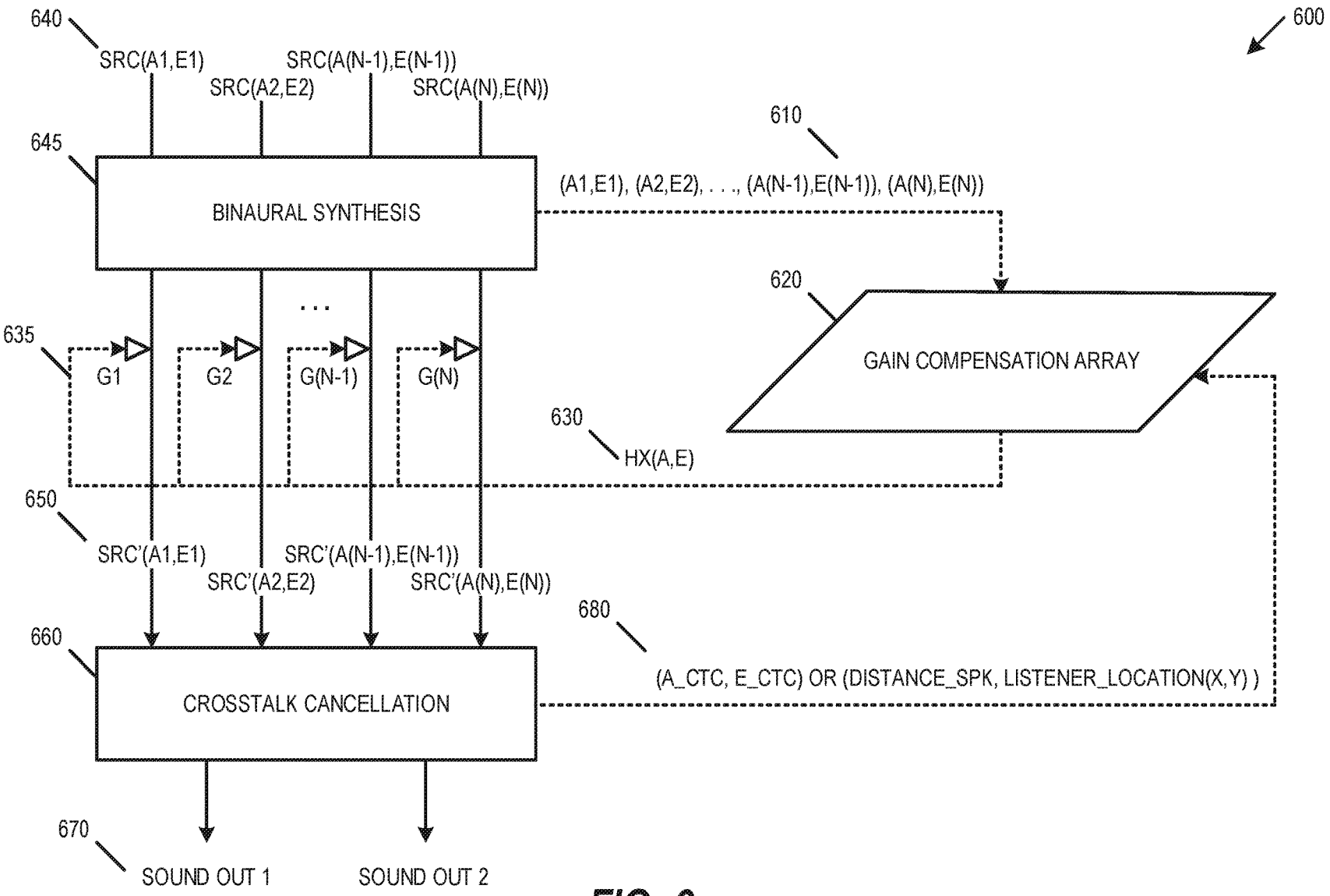
FIG. 6 is a block diagram of a preconditioning and binaural synthesis loudspeaker-based virtualization system, according to an example embodiment.
Figure 7:
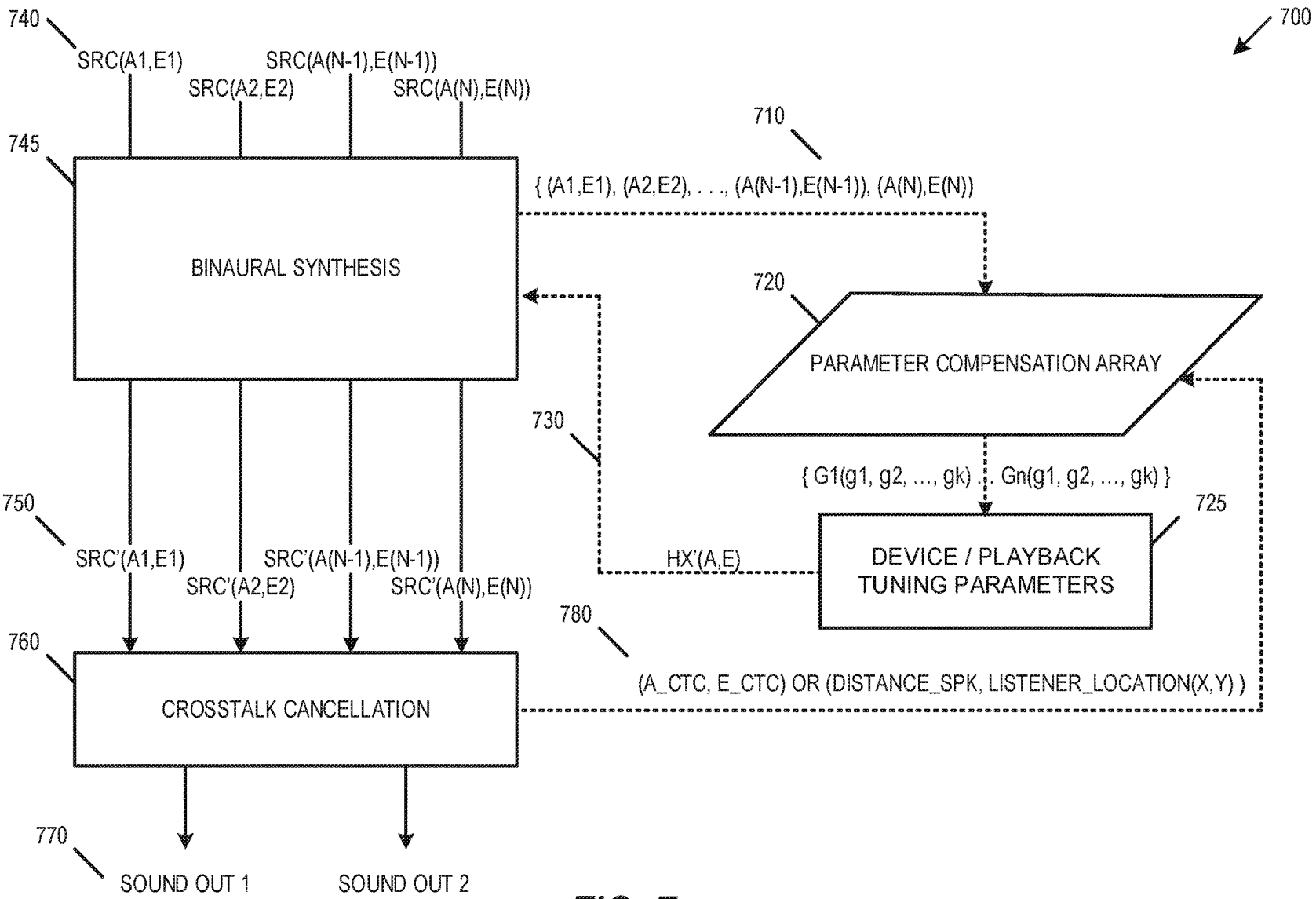
FIG. 7 is a block diagram of a preconditioning and binaural synthesis parametric virtualization system, according to an example embodiment.

FIG. 4 includes a CTC loudness line graph 400, according to an example embodiment. As described above, a single gain value at each azimuth cannot accurately compensate power or loudness differences for different CTC and sound sources in different intended locations. Line graph 400 shows the curves (e.g., trajectories) of the loudness values for the sound sources in separate locations. Notably, when azimuth of the CTC increases, the relative change in loudness (e.g., loudness delta) is inconsistent. The curves and the loudness deltas are also different when the elevation angle parameter of the crosstalk canceller changes. An example system for addressing these inconsistencies is shown in FIGS. 6-7, below.

Figure 5:
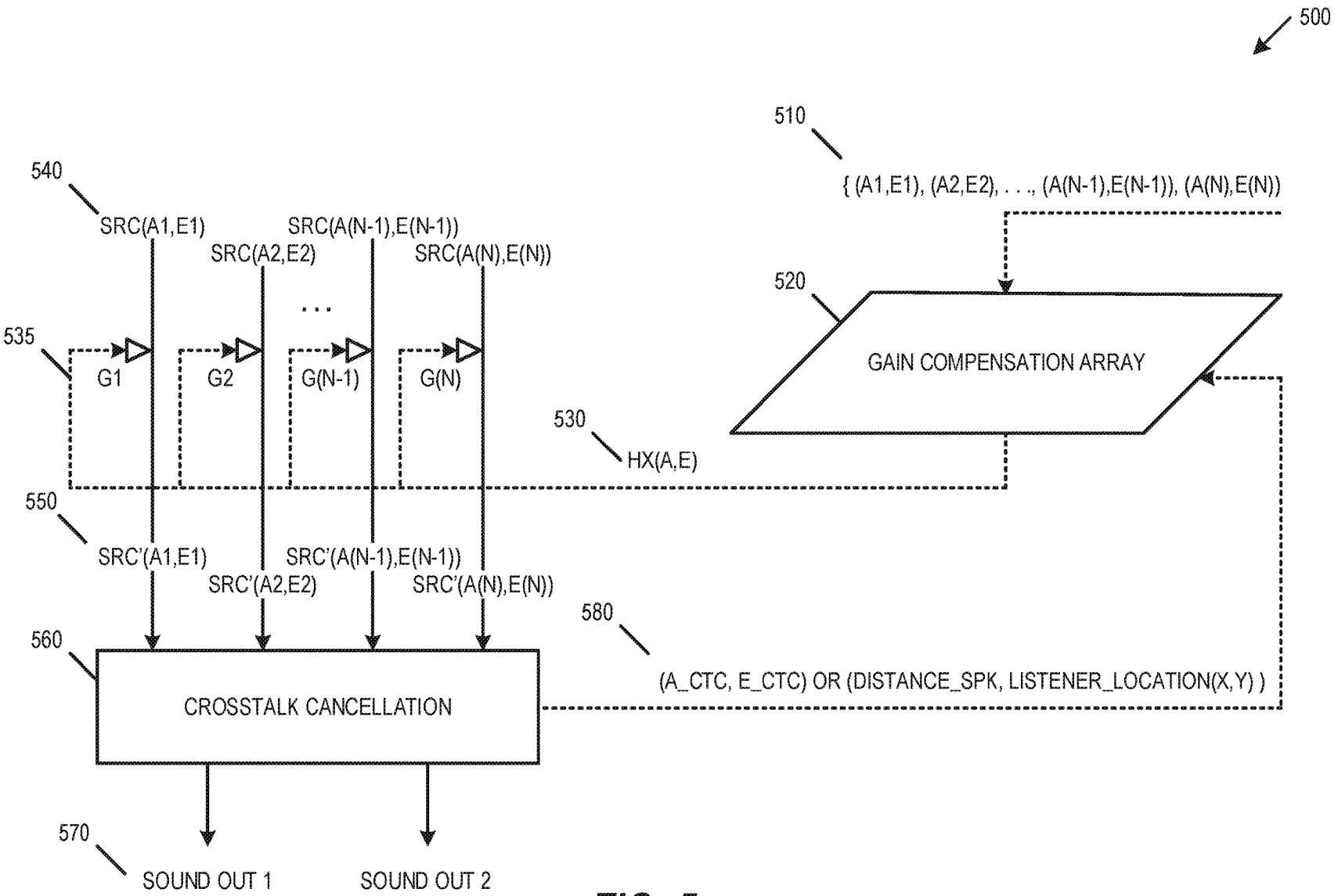
FIG. 5 is a block diagram of a preconditioning loudspeaker-based virtualization system, according to an example embodiment.

FIG. 5 is a block diagram of a preconditioning loudspeaker-based virtualization system 500, according to an example embodiment. To address the inconsistencies among sound sources in separate locations, the present solutions use a separate offset value for each set of CTC filters H×(A,E), where each CTC filter H×(A,E) corresponds to each of the sound sources at azimuth "A" and elevation "E". As shown in FIG. 5, system 500 uses CTC system and signal input characteristics 510 within a gain compensation array 520 to generate the CTC filter H×(A,E) 530. The gain compensation array 520 may include a frequency-dependent gain compensation array to compensate for timbre, or may include a frequency-independent gain compensation array. The CTC filter H×(A,E) 530 may modify each source signal SRC 540 by a corresponding gain G to generate a compensated signal SRC' 550, such as shown in Equation 1 below:

$$SRC'(A_S,E_S)=SRC(A_S,E_S)\times G(A_S,E_S,A_C,E_C)\times W_K \quad \text{Eq. 1}$$

SRC' 550 is the compensated signal provided to the crosstalk cancellation 560, SRC 540 is the original sound source, G is the quantified power difference (e.g., gain) for given azimuths and elevations of the sound source (e.g., for $A_S$ and $E_S$) and CTC (e.g., for $A_C$ and $E_C$), and $W_K$ is a weighting value. Based on the input compensated signal SRC' 550, the crosstalk cancellation 560 generates a binaural sound output 570 including a first and second output sound channels. The crosstalk cancellation 560 may also provide audio characterization feedback 580 to the gain compensation array 520, where the audio characterization feedback 580 may include CTC azimuth and elevation information, distance to each loudspeaker (e.g., sound source), listener location, or other information. The gain compensation array 520 may use the audio characterization feedback 580 to improve the compensation provided by the CTC filter H×(A,E) 530.

FIG. 6 is a block diagram of a preconditioning and binaural synthesis loudspeaker-based virtualization system 600, according to an example embodiment. Similar to system 500, system 600 shows a preconditioning process with pre-calculated data module whose inputs describe CTC system characteristics and characteristics of signal inputs. In contrast with system 500, system 600 includes an additional binaural synthesis 645 so that the system response is known, where the binaural synthesis provides CTC system and signal input characteristics 610 to the gain compensation array 620 to generate the CTC filter H×(A,E) 630. The gain compensation array 620 may include a frequency-dependent gain compensation array to compensate for timbre, or may include a frequency-independent gain compensation array. The CTC filter H×(A,E) 630 may modify each source signal SRC 640 by a corresponding gain G to generate a compensated signal SRC' 650 as shown in Equation 1. Based on the input compensated signal SRC' 650, the crosstalk cancellation 660 generates a binaural sound output 670 including a first and second output sound channels. The crosstalk cancellation 660 may also provide audio characterization feedback 680 back to the gain compensation array 620, where the gain compensation array 620 may use the audio characterization feedback 680 to improve the compensation provided by the CTC filter H×(A,E) 630.

FIG. 7 is a block diagram of a preconditioning and binaural synthesis parametric virtualization system 700, according to an example embodiment. While system 500 and system 600 include a single gain for each input signal, system 700 provides additional options for gain conditioning for loudness. In particular, system 700 may include a parameter compensation array 720 and device or playback tuning parameters 725. The parameter compensation array 720 may include a frequency-dependent parameter compensation array to compensate for timbre, or may include a frequency-independent parameter compensation array. The playback tuning parameters 725 may be provided by a user, a sound engineer, a microphone-based audio audit application, or other input. The playback tuning parameters 725 provide the ability to tune the gains, such as to modify the audio response to compensate for room-specific reflections for a particular location. In the embodiments shown in FIG. 2 and FIG. 3, the playback tuning parameters 725 provide the ability to improve the match between the original loudness (210, 310) and the loudness with the CTC (220, 320). The playback tuning parameters 725 may be provided directly by a user (e.g., modifying a parameter) or may be implemented within a digital signal processor (DSP) through a programmer-accessible application programming interface (API).

The playback tuning parameters 725 may be used to generate a modified CTC filter H×'(A,E) 730, which may be used to modify each source signal SRC 740 by a corresponding gain G to generate a compensated signal SRC' 750 as shown in Equation 1. Based on the input compensated signal SRC' 750, the crosstalk cancellation 760 generates a binaural sound output 770 including a first and second output sound channels. The crosstalk cancellation 760 may also provide audio characterization feedback 780 back to the gain compensation array 720, where the gain compensation array 720 may use the audio characterization feedback 780 to improve the compensation provided by parameter compensation array 720.

As described herein, the audio source may include multiple audio signals (i.e., signals representing physical sound). These audio signals are represented by digital electronic signals. These audio signals may be analog, however typical embodiments of the present subject matter would operate in the context of a time series of digital bytes or words, where these bytes or words form a discrete approximation of an analog signal or ultimately a physical sound. The discrete, digital signal corresponds to a digital representation of a periodically sampled audio waveform. For uniform sampling, the waveform is to be sampled at or above a rate sufficient to satisfy the Nyquist sampling theorem for the frequencies of interest. In a typical embodiment, a uniform sampling rate of approximately 44,100 samples per second (e.g., 44.1 kHz) may be used, however higher sampling rates (e.g., 96 kHz, 128 kHz) may alternatively be used. The quantization scheme and bit resolution should be chosen to satisfy the requirements of a particular application, according to standard digital signal processing techniques. The techniques and apparatus of the present subject matter typically would be applied interdependently in a number of channels. For example, it could be used in the context of a "surround" audio system (e.g., having more than two channels).

As used herein, a "digital audio signal" or "audio signal" does not describe a mere mathematical abstraction, but instead denotes information embodied in or carried by a physical medium capable of detection by a machine or apparatus. These terms include recorded or transmitted signals, and should be understood to include conveyance by any form of encoding, including pulse code modulation (PCM) or other encoding. Outputs, inputs, or intermediate audio signals could be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be required to accommodate a particular compression or encoding method, as will be apparent to those with skill in the art.

In software, an audio "codec" includes a computer program that formats digital audio data according to a given audio file format or streaming audio format. Most codecs are implemented as libraries that interface to one or more multimedia players, such as QuickTime Player, XMMS, Winamp, Windows Media Player, Pro Logic, or other codecs. In hardware, audio codec refers to one or more devices that encode analog audio as digital signals and decode digital back into analog. In other words, it contains both an analog-to-digital converter (ADC) and a digital-to-analog converter (DAC) running off a common clock.

An audio codec may be implemented in a consumer electronics device, such as a DVD player, Blu-Ray player, TV tuner, CD player, handheld player, Internet audio/video device, gaming console, mobile phone, or another electronic device. A consumer electronic device includes a Central Processing Unit (CPU), which may represent one or more conventional types of such processors, such as an IBM PowerPC, Intel Pentium (x86) processors, or other processor. A Random Access Memory (RAM) temporarily stores results of the data processing operations performed by the CPU, and is interconnected thereto typically via a dedicated memory channel. The consumer electronic device may also include permanent storage devices such as a hard drive, which are also in communication with the CPU over an input/output (I/O) bus. Other types of storage devices such as tape drives, optical disk drives, or other storage devices may also be connected. A graphics card may also be connected to the CPU via a video bus, where the graphics card transmits signals representative of display data to the display monitor. External peripheral data input devices, such as a keyboard or a mouse, may be connected to the audio reproduction system over a USB port. A USB controller translates data and instructions to and from the CPU for external peripherals connected to the USB port. Additional devices such as printers, microphones, speakers, or other devices may be connected to the consumer electronic device.

The consumer electronic device may use an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, or other operating systems. The consumer electronic device may execute one or more computer programs. Generally, the operating system and computer programs are tangibly embodied in a computer-readable medium, where the computer-readable medium includes one or more of the fixed or removable data storage devices including the hard drive. Both the operating system and the computer programs may be loaded from the aforementioned data storage devices into the RAM for execution by the CPU. The computer programs may comprise instructions, which when read and executed by the CPU, cause the CPU to perform the steps to execute the steps or features of the present subject matter.

The audio codec may include various configurations or architectures. Any such configuration or architecture may be readily substituted without departing from the scope of the present subject matter. A person having ordinary skill in the art will recognize the above-described sequences are the most commonly used in computer-readable mediums, but there are other existing sequences that may be substituted without departing from the scope of the present subject matter.

Elements of one embodiment of the audio codec may be implemented by hardware, firmware, software, or any combination thereof. When implemented as hardware, the audio codec may be employed on a single audio signal processor or distributed amongst various processing components. When implemented in software, elements of an embodiment of the present subject matter may include code segments to perform the necessary tasks. The software preferably includes the actual code to carry out the operations described in one embodiment of the present subject matter, or includes code that emulates or simulates the operations. The program or code segments can be stored in a processor or machine accessible medium or transmitted by a computer data signal embodied in a carrier wave (e.g., a signal modulated by a carrier) over a transmission medium. The "processor readable or accessible medium" or "machine readable or accessible medium" may include any medium that can store, transmit, or transfer information.

Examples of the processor readable medium include an electronic circuit, a semiconductor memory device, a read only memory (ROM), a flash memory, an erasable programmable ROM (EPROM), a floppy diskette, a compact disk (CD) ROM, an optical disk, a hard disk, a fiber optic medium, a radio frequency (RF) link, or other media. The computer data signal may include any signal that can propagate over a transmission medium such as electronic network channels, optical fibers, air, electromagnetic, RF links, or other transmission media. The code segments may be downloaded via computer networks such as the Internet, Intranet, or another network. The machine accessible medium may be embodied in an article of manufacture. The machine accessible medium may include data that, when accessed by a machine, cause the machine to perform the operation described in the following. The term "data" here refers to any type of information that is encoded for machine-readable purposes, which may include program, code, data, file, or other information.

Embodiments of the present subject matter may be implemented by software. The software may include several modules coupled to one another. A software module is coupled to another module to generate, transmit, receive, or process variables, parameters, arguments, pointers, results, updated variables, pointers, or other inputs or outputs. A software module may also be a software driver or interface to interact with the operating system being executed on the platform. A software module may also be a hardware driver to configure, set up, initialize, send, or receive data to or from a hardware device.

Embodiments of the present subject matter may be described as a process that is usually depicted as a flowchart, a flow diagram, a structure diagram, or a block diagram. Although a block diagram may describe the operations as a sequential process, many of the operations can be performed in parallel or concurrently. In addition, the order of the operations may be rearranged. A process may be terminated when its operations are completed. A process may, correspond to a method, a program, a procedure, or other group of steps.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description. This disclosure has been described in detail and with reference to exemplary embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents. Each patent and publication referenced or mentioned herein is hereby incorporated by reference to the same extent as if it had been incorporated by reference in its entirety individually or set forth herein in its entirety. Any conflicts of these patents or publications with the teachings herein are controlled by the teaching herein.

To better illustrate the method and apparatuses disclosed herein, a non-limiting list of embodiments is provided here.

Example 1 is an immersive sound system comprising: one or more processors; a storage device comprising instructions, which when executed by the one or more processors, configure the one or more processors to: receive a plurality of audio sound sources, each of the plurality of audio sound sources being associated with a corresponding intended sound source location within a plurality of three-dimensional sound source locations; generate a compensation array output based on the plurality of three-dimensional sound source locations, the compensation array output including a plurality of compensated gains; and generate a plurality of compensated audio sources based on the plurality of audio sound sources and the plurality of compensated gains.

In Example 2, the subject matter of Example 1 optionally includes the instructions further configuring the one or more processors to: generate a binaural crosstalk cancellation output based on the plurality of compensated audio sources; and transduce a binaural sound output based on the binaural crosstalk cancellation output.

In Example 3, the subject matter of Example 2 optionally includes the instructions further configuring the one or more processors to receive sound source metadata, wherein the plurality of three-dimensional sound source locations are based on the received sound source metadata.

In Example 4, the subject matter of any one or more of Examples 2-3 optionally include wherein: the plurality of audio sound sources are associated with a standard surround sound device layout; and the plurality of three-dimensional sound source locations are based on the predetermined surround sound device layout.

In Example 5, the subject matter of Example 4 optionally includes surround sound.

In Example 6, the subject matter of any one or more of Examples 1-5 optionally include the instructions further configuring the one or more processors to receive a tuning parameter, wherein the generation of the compensation array output is based on the received tuning parameter.

In Example 7, the subject matter of Example 6 optionally includes the instructions further configuring the one or more processors to: receive a user tuning input; and generate the tuning parameter is based on the received user tuning input.

In Example 8, the subject matter of any one or more of Examples 1-7 optionally include wherein the generation of the compensation array output is based on a frequency-dependent compensation array to compensate for timbre.

In Example 9, the subject matter of any one or more of Examples 1-8 optionally include wherein the generation of the compensation array output is based on a frequency-independent compensation array.

In Example 10, the subject matter of any one or more of Examples 3-9 optionally include wherein the generation of the compensation array output is further based on the binaural crosstalk cancellation output.

In Example 11, the subject matter of any one or more of Examples 3-10 optionally include wherein the binaural crosstalk cancellation output includes CTC azimuth and elevation information.

In Example 12, the subject matter of any one or more of Examples 3-11 optionally include wherein the binaural crosstalk cancellation output includes a listener location and a distance to each of a plurality of loudspeakers.

Example 13 is an immersive sound method comprising: receiving a plurality of audio sound sources, each of the plurality of audio sound sources being associated with a corresponding intended sound source location within a plurality of three-dimensional sound source locations; generating a compensation array output based on the plurality of three-dimensional sound source locations, the compensation array output including a plurality of compensated gains; and generating a plurality of compensated audio sources based on the plurality of audio sound sources and the plurality of compensated gains.

In Example 14, the subject matter of Example 13 optionally includes generating a binaural crosstalk cancellation output based on the plurality of compensated audio sources; and transducing a binaural sound output based on the binaural crosstalk cancellation output.

In Example 15, the subject matter of Example 14 optionally includes receiving sound source metadata, wherein the plurality of three-dimensional sound source locations are based on the received sound source metadata.

In Example 16, the subject matter of any one or more of Examples 14-15 optionally include wherein: the plurality of audio sound sources are associated with a standard surround sound device layout; and the plurality of three-dimensional sound source locations are based on the predetermined surround sound device layout.

In Example 17, the subject matter of Example 16 optionally includes surround sound.

In Example 18, the subject matter of any one or more of Examples 13-17 optionally include receiving a tuning parameter, wherein the generation of the compensation array output is based on the received tuning parameter.

In Example 19, the subject matter of Example 18 optionally includes receiving a user tuning input; and generating the tuning parameter is based on the received user tuning input.

In Example 20, the subject matter of any one or more of Examples 13-19 optionally include wherein the generation of the compensation array output is based on a frequency-dependent compensation array to compensate for timbre.

In Example 21, the subject matter of any one or more of Examples 13-20 optionally include wherein the generation of the compensation array output is based on a frequency-independent compensation array.

In Example 22, the subject matter of any one or more of Examples 15-21 optionally include wherein the generation of the compensation array output is further based on the binaural crosstalk cancellation output.

In Example 23, the subject matter of any one or more of Examples 15-22 optionally include wherein the binaural crosstalk cancellation output includes CTC azimuth and elevation information.

In Example 24, the subject matter of any one or more of Examples 15-23 optionally include wherein the binaural crosstalk cancellation output includes a listener location and a distance to each of a plurality of loudspeakers.

Example 25 is one or more machine-readable medium including instructions, which when executed by a computing system, cause the computing system to perform any of the methods of Examples 13-4.3.

Example 26 is an apparatus comprising means for performing any of the methods of Examples 13-24.

Example 27 is a machine-readable storage medium comprising a plurality of instructions that, when executed with a processor of a device, cause the device to: receive a plurality of audio sound sources, each of the plurality of audio sound sources being associated with a corresponding intended sound source location within a plurality of three-dimensional sound source locations; generate a compensation array output based on the plurality of three-dimensional sound source locations, the compensation array output including a plurality of compensated gains; and generate a plurality of compensated audio sources based on the plurality of audio sound sources and the plurality of compensated gains.

In Example 28, the subject matter of Example 27 optionally includes the instructions causing the device to: generate a binaural crosstalk cancellation output based on the plurality of compensated audio sources; and transduce a binaural sound output based on the binaural crosstalk cancellation output.

In Example 29, the subject matter of Example 28 optionally includes the instructions causing the device to receive sound source metadata, wherein the plurality of three-dimensional sound source locations are based on the received sound source metadata.

In Example 30, the subject matter of any one or more of Examples 28-29 optionally include wherein: the plurality of audio sound sources are associated with a standard surround sound device layout; and the plurality of three-dimensional sound source locations are based on the predetermined surround sound device layout.

In Example 31, the subject matter of Example 30 optionally includes surround sound.

In Example 32, the subject matter of any one or more of Examples 27-31 optionally include the instructions causing the device to receive a tuning parameter, wherein the generation of the compensation array output is based on the received tuning parameter.

In Example 33, the subject matter of Example 32 optionally includes the instructions causing the device to: receive a user tuning input; and generate the tuning parameter is based on the received user tuning input.

In Example 34, the subject matter of any one or more of Examples 27-33 optionally include wherein the generation of the compensation array output is based on a frequency-dependent compensation array to compensate for timbre.

In Example 35, the subject matter of any one or more of Examples 27-34 optionally include wherein the generation of the compensation array output is based on a frequency-independent compensation array.

In Example 36, the subject matter of any one or more of Examples 29-35 optionally include wherein the generation of the compensation array output is further based on the binaural crosstalk cancellation output.

In Example 37, the subject matter of any one or more of Examples 29-36 optionally include wherein the binaural crosstalk cancellation output includes CTC azimuth and elevation information.

In Example 38, the subject matter of any one or more of Examples 29-37 optionally include wherein the binaural crosstalk cancellation output includes a listener location and a distance to each of a plurality of loudspeakers.

Example 39 is an immersive sound system apparatus comprising: means for receiving a plurality of audio sound sources, each of the plurality of audio sound sources being associated with a corresponding intended sound source location within a plurality of three-dimensional sound source locations; means for generating a compensation array output based on the plurality of three-dimensional sound source locations, the compensation array output including a plurality of compensated gains; and means for generating a plurality of compensated audio sources based on the plurality of audio sound sources and the plurality of compensated gains.

Example 40 is one or more machine-readable medium including instructions, which when executed by a machine, cause the machine to perform operations of any of the operations of Examples 1-39.

Example 41 is an apparatus comprising means for performing any of the operations of Examples 1-39.

Example 42 is a system to perform the operations of any of the Examples 1-39.

Example 43 is a method to perform the operations of any of the Examples 1-39.

The above detailed description includes references to the accompanying drawings, which form a part of the detailed description. The drawings show specific embodiments by way of illustration. These embodiments are also referred to herein as "examples." Such examples can include elements in addition to those shown or described. Moreover, the subject matter may include any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." in this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. In the above Detailed Description, various features may be grouped together to streamline the disclosure. This should not be interpreted as intending that an unclaimed disclosed feature is essential to any claim. Rather, the subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope should be determined with reference to the appended claims, along with the full scope of equivalents to which such claims are entitled.

What is claimed is:

1. An immersive sound system comprising:

one or more processors;

a storage device comprising instructions, which when executed by the one or more processors, configure the one or more processors to:

receive a plurality of audio sound sources, each of the plurality of audio sound sources being associated with a corresponding intended sound source location within a plurality of three-dimensional sound source locations;

receive a playback device information data set;

generate a gain compensation array output based on the plurality of three-dimensional sound source locations and the playback device information data set, the gain compensation array output including a plurality of compensated gains;

generate a plurality of compensated audio sources based on the plurality of audio sound sources and the plurality of compensated gains; and generate a binaural crosstalk cancellation output including a crosstalk-compensated left binaural channel signal and a crosstalk-compensated right binaural channel signal, the binaural crosstalk cancellation output including crosstalk cancellation based on the plurality of compensated audio sources.

2. The immersive sound system of claim 1, the instructions further configuring the one or more processors to transduce a binaural sound output based on the binaural crosstalk cancellation output.

3. The immersive sound system of claim 1, the instructions further configuring the one or more processors to receive sound source metadata, wherein the plurality of three-dimensional sound source locations are based on the received sound source metadata.

4. The immersive sound system of claim 3, wherein the generation of the compensation array output is further based on the binaural crosstalk cancellation output.

5. The immersive sound system of claim 3, wherein the binaural crosstalk cancellation output includes crosstalk cancellation azimuth and elevation information.

6. The immersive sound system of claim 3, wherein the binaural crosstalk cancellation output includes a listener location and a distance to each of a plurality of loudspeakers.

7. The immersive sound system of claim 1, wherein:

the plurality of audio sound sources are associated with a standard surround sound device layout; and the plurality of three-dimensional sound source locations are based on the standard surround sound device layout.

8. The immersive sound system of claim 7, wherein the standard surround sound device layout includes at least one of 5.1 surround sound, 7.1 surround sound, 10.2 surround sound, 11.1 surround sound, and 22.2 surround sound.

9. The immersive sound system of claim 1, the instructions further configuring the one or more processors to receive a tuning parameter, wherein the generation of the compensation array output is based on the received tuning parameter.

10. The immersive sound system of claim 1, the instructions further configuring the one or more processors to receive a user tuning input, wherein the generation of the compensation array output is based on the received user tuning input.

11. The immersive sound system of claim 1, wherein the generation of the compensation array output is based on a frequency-dependent compensation array to compensate for timbre.

12. An immersive sound method comprising:

receiving a plurality of audio sound sources, each of the plurality of audio sound sources being associated with a corresponding intended sound source location within a plurality of three-dimensional sound source locations;

receiving a playback device information data set;

generating a gain compensation array output based on the plurality of three-dimensional sound source locations and the playback device information data set, the gain compensation array output including a plurality of compensated gains;

generating a plurality of compensated audio sources based on the plurality of audio sound sources and the plurality of compensated gains; and generating a binaural crosstalk cancellation output including a crosstalk-compensated left binaural channel signal and a crosstalk-compensated right binaural channel signal, the binaural crosstalk cancellation output including crosstalk cancellation based on the plurality of compensated audio sources.

13. The immersive sound method of claim 12, further including transducing a binaural sound output based on the binaural crosstalk cancellation output.

14. The immersive sound method of claim 12, further including receiving sound source metadata, wherein the plurality of three-dimensional sound source locations are based on the received sound source metadata.

15. The immersive sound method of claim 12, wherein:

the plurality of audio sound sources are associated with a standard surround sound device layout; and the plurality of three-dimensional sound source locations are based on the standard surround sound device layout.

16. The immersive sound method of claim 12, further including receiving a tuning parameter, wherein the generation of the compensation array output is based on the received tuning parameter.

17. The immersive sound method of claim 16, further including:

receiving a user tuning input; and generating the tuning parameter is based on the received user tuning input.

18. A non-transitory machine-readable storage medium comprising a plurality of instructions that, when executed with a processor of a device, cause the device to:

receive a plurality of audio sound sources, each of the plurality of audio sound sources being associated with a corresponding intended sound source location within a plurality of three-dimensional sound source locations;

receive a playback device information data set;

generate a gain compensation array output based on the plurality of three-dimensional sound source locations and the playback device information data set, the gain compensation array output including a plurality of compensated gains;

generate a plurality of compensated audio sources based on the plurality of audio sound sources and the plurality of compensated gains; and generate a binaural crosstalk cancellation output including a crosstalk-compensated left binaural channel signal and a crosstalk-compensated right binaural channel signal, the binaural crosstalk cancellation output including crosstalk cancellation based on the plurality of compensated audio sources.

19. The non-transitory machine-readable storage medium of claim 18, the instructions causing the device to transduce a binaural sound output based on the binaural crosstalk cancellation output.

20. The non-transitory machine-readable storage medium of claim 18, the instructions causing the device to receive a tuning parameter, wherein the generation of the compensation array output is based on the received tuning parameter.

* * * * *